US007147767B2

(12) United States Patent
Boyd et al.

(10) Patent No.: US 7,147,767 B2
(45) Date of Patent: Dec. 12, 2006

(54) PLATING SOLUTIONS FOR ELECTROCHEMICAL OR CHEMICAL DEPOSITION OF COPPER INTERCONNECTS AND METHODS THEREFOR

(75) Inventors: Steven D. Boyd, Woodbury, MN (US); Susrut Kesari, Santa Clara, CA (US); William M. Lamanna, Stillwater, MN (US); Michael J. Parent, Oakdale, MN (US); Lawrence A. Zazzera, Edina, MN (US); Haiyan Zhang, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 451 days.

(21) Appl. No.: 10/320,263

(22) Filed: Dec. 16, 2002

(65) Prior Publication Data

US 2004/0112756 A1 Jun. 17, 2004

(51) Int. Cl.
*C25D 3/38* (2006.01)
*C23C 18/00* (2006.01)

(52) U.S. Cl. ..... 205/296; 205/291; 106/1.26

(58) Field of Classification Search ..... 106/1.26; 205/291, 296

See application file for complete search history.

(56) References Cited

U.S. PATENT DOCUMENTS

| | | | | |
|---|---|---|---|---|
| 5,502,251 | A * | 3/1996 | Pohmer et al. | 564/82 |
| 5,652,072 | A | 7/1997 | Lamanna et al. | |
| 5,767,054 | A | 6/1998 | Sprugel et al. | |
| 6,194,317 | B1 | 2/2001 | Kaisaki et al. | |
| 6,245,663 | B1 | 6/2001 | Zhao et al. | |
| 6,284,656 | B1 | 9/2001 | Farrar | |
| 6,287,954 | B1 | 9/2001 | Ashley et al. | |
| 6,287,973 | B1 | 9/2001 | Aoi | |
| 6,287,977 | B1 | 9/2001 | Hashim et al. | |
| 6,290,833 | B1 | 9/2001 | Chen | |
| 6,291,082 | B1 | 9/2001 | Lopatin | |
| 6,291,333 | B1 | 9/2001 | Lou | |
| 6,291,887 | B1 | 9/2001 | Wang et al. | |
| 6,358,899 | B1 | 3/2002 | Hackett | |

FOREIGN PATENT DOCUMENTS

| | | |
|---|---|---|
| EP | 0 419 845 | 4/1991 |
| EP | 1 134 218 | 9/2001 |
| EP | 1333477 | 8/2003 |
| JP | 11092754 | 4/1999 |
| WO | WO 99/30381 | 6/1999 |
| WO | WO 01/74985 A1 | 10/2001 |
| WO | WO 01/75955 A1 | 10/2001 |
| WO | WO 02/45142 | 6/2002 |
| WO | WO 02/092211 A2 | 11/2002 |

OTHER PUBLICATIONS

Article: Edelstein et al., "Copper Interconnect Technology in Semiconductor Manufacturing," *Electrochemical Society Proceedings vol. 99-9*, (date unknown but prior to filing date of present application), pp. 1-9.

Article: Braun, "Aluminum Persists as Copper Age Dawns," *Semiconductor International*, vol. 22, No. 9, Aug. 1999, pp. 58-60, 63, 64, & 66.

Article: Singer, "Dual-Damascene Challenges Dielectric Etch," *Semiconductor International*, vol. 22, No. 9, Aug. 1999, pp. 68-70 & 72.

Article: Braun, "Copper Metrology Gains Complexity, Capabilities," *Semiconductor International*, vol. 24, No. 10, Sep. 2001, pp. 56-58, 60, 64, & 70.

Article: Martyak et al., "Copper Sulfonate Electrolytes for Metallization of Interconnect Technology," American Electroplaters and Surface Finishing Conference, Chicago, IL, Jun. 26, 2000, 15 pages.

* cited by examiner

*Primary Examiner*—Edna Wong

(57) ABSTRACT

The present invention provides plating solutions having either copper bis(perfluoroalkanesulfonyl) imides or copper tris(perfluoroalkanesulfonyl) methides and methods of electrochemically or chemically depositing copper interconnects using these plating solutions.

25 Claims, No Drawings

PLATING SOLUTIONS FOR ELECTROCHEMICAL OR CHEMICAL DEPOSITION OF COPPER INTERCONNECTS AND METHODS THEREFOR

FIELD OF INVENTION

This invention relates to plating solutions for the chemical or electrochemical deposition of copper interconnects in semiconductor devices, to methods of using these plating solutions, and to copper methide salts. More particularly, this invention relates to electroless or electrolytic plating solutions comprising at least one copper bis(perfluoroalkanesulfonyl) imide or at least one copper tris(perfluoroalkanesulfonyl) methide, to a method of using these plating solutions for the deposition of copper interconnects, and to copper tris(perfluoroalkanesulfonyl) methides.

BACKGROUND OF THE INVENTION

Integrated circuits are found in a variety of electronic and computer products. Integrated circuits are interconnected networks of electrical components formed on a common foundation or substrate. Manufacturers typically use techniques such as layering, doping, masking, and etching to build thousands and even millions of microscopic resistors, transistors, and other electrical components on a silicon wafer. These components are then wired, or interconnected, together to form a specific electric circuit, for example, a computer memory.

Typically, the components are covered with an insulating layer of silicon dioxide. Then, small holes, or "vias," are etched in the insulating layer to expose portions of the components underneath. Trenches are then dug in the layer to define a wiring pattern. Thus, millions of microscopic components are interconnected. Then, through metallization, the holes and trenches are filled to form sub-micron diameter wires between the components.

The semiconductor industry uses a damascene or dual damascene process to form the interconnects. The damascene process involves forming patterns in a dielectric layer (etching), filling the resulting pattern with interconnect metal, then polishing away the excess metal on the wafer surface and leaving inlaid interconnect metal features.

Aluminum has traditionally been used as the conductive interconnect material. In making high performance microprocessor chips, however, copper is now often used as an interconnect material. Copper is often preferred because of its low electrical resistivity, and its lower resistance-capacitance (RC) time delays in the metal interconnect that limit the performance of high-speed logic chips. Electrochemical deposition of copper is preferred because of its trench-filling capacity in the damascene process, and the relatively low cost of the damascene manufacturing process.

Copper damascene and copper dual damascene manufacturing is becoming more common due to the performance of copper interconnect material and the cost advantages of the dual damascene process. In the damascene process, a trench pattern is defined by etching through the dielectric materials. The trenches are then filled with electroplated copper and the interconnect pattern is obtained through a subsequent CMP (Chemical Mechanical Polishing) process. Copper damascene refers to the process where vertical copper interconnects (called plugs or vias) are formed between different layers of metal. Copper dual damascene refers to the process where the vertical plugs and the layers of metal are all formed in the same step. Copper dual damascene involves etching vias into the oxide, filling with copper, and then polishing down to the top of the copper to leave the horizontal copper layer and the vertical copper plugs. This type of manufacturing requires strict control of electroplating and polishing of the copper.

Electroplating is the preferred method for depositing the copper interconnect material to fill the trenches because of its trench filling capacity and its relatively low cost.

Copper electroplating from acidified copper sulfate is commonly used in the industry. Acidic copper plating solutions typically consist of three main components: (1) copper sulfate, which is the source of copper and is typically in the range of 0.2 to 1.0 M, (2) sulfuric acid, which provides conductivity to the electrolyte and is typically in the range of 0.5 to 1.1 M, and (3) various additives, which are typically present at 1 weight percent or below.

Recently, copper alkane sulfonate and perfluoroalkanesulfonate salts have shown an advantage in some aspects over the copper sulfate salts for the deposition of copper interconnects. See "Copper Sulfonate Electrolytes for Metallization of Interconnect Technology," N. M. Martyak, R. Mikkola, American Electroplaters and Surface Finishing Conference, Chicago, Ill., Jun. 26, 2000. This reference discloses copper electrodeposition from methanesulfonate, ethanesulfonate, propanesulfonate, and trifluoromethanesulfonate solutions.

A low free acid concentration may be desirable because there is less likelihood of damage to the very thin copper seed layer. If the copper seed layer is damaged, it will lead to non-uniformity or void formation in the copper interconnects. But if free acid is present, a wider free acid range latitude makes it easier to control plating uniformity.

Plating solutions that produce less overfill are desirable. Less overfill is desirable because the copper coated substrates need to be planarized as part of the damascene or dual damascene process. With less overfill, there is less planarization required.

Plating efficiency can also be improved by improving conductivity of the solution.

Higher electrolyte conductivity requires less voltage to plate at a given current density, which in turn lowers energy consumption.

Thus, the need exists for an electrolytic solution having a low or no free acid concentration, having good conductivity, and having less overfill during copper plating. Additionally, the need exists for an electrolytic solution having a wide free acid range latitude, having good conductivity, and having less overfill during copper plating.

Alternatively, copper plating can be achieved by chemical methods, such as electroless plating. In electroless plating, reduction of dissolved copper ions to metallic copper is achieved by chemical means through the action of a reducing agent. Usually the chemical reduction of copper ion to metallic copper is catalyzed by a metallic seed layer, such as colloidal Pd. The performance of electroless plating solutions can be influenced by the structure of the counter anion. Thus, the need exists for counter anions for use in copper electroless plating solutions that improves the wetting and plating performance of these solutions.

SUMMARY OF THE INVENTION

The present invention provides plating solutions comprising either copper imide salts or copper methide salts for use in the chemical (i.e., electroless) or electrochemical deposition of copper interconnects. Advantageously, in one embodiment of the present invention, the solutions of the present invention have little or no free acids. In another embodiment of the present invention, the solutions have a wide free acid range latitude. The solutions of the present invention are comprised of perfluorinated imide anions (bis(perfluoroalkanesulfonyl) imides; $^{-}N(SO_2C_nF_{2n+1})_2$) or perfluorinated methide anions (tris(perfluoroalkanesulfonyl) methides; $^{-}C(SO_2C_nF_{2n+1})_3$).

In one aspect, the present invention comprises an electrolytic plating solution having or consisting essentially of:

a) at least one copper bis(perfluoroalkanesulfonyl) imide represented by the formula

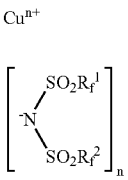

where $R_f^1$ and $R_f^2$ are independently a perfluoroalkyl group that may be cyclic or acyclic, may optionally contain catenated ("in-chain") or terminal heteroatoms selected from the group consisting of N, O, and S (e.g., —$SF_4$—, —$SF_5$), any two $R_f$ groups may be linked to form a perfluoroalkylene-containing ring, and comprising from 1 to 12 carbon atoms, and n is an integer from 1 to 2; and b) solvent.

In another aspect, the present invention comprises an electrolytic plating solution consisting essentially of:

a) at least one copper bis(perfluoroalkanesulfonyl) imide represented by the formula

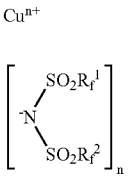

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2;

b) solvent;

c) acid; and d) optionally one or more additive.

In yet another embodiment, the present invention comprises an electrolytic plating solution comprising:

a) at least one copper bis(perfluoroalkanesulfonyl) imide represented by the formula

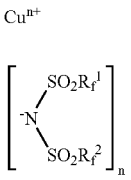

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2; where the concentration of the copper cation ranges from about 0.10 M to about 1.5 M in solvent;

b) solvent;

c) acid; and d) optionally one or more additive.

In yet another embodiment, the present invention comprises a method of electrochemically depositing copper interconnects comprising the steps of:

a) providing an electrolytic solution consisting essentially of (i) at least one copper bis(perfluoroalkanesulfonyl) imide represented by the formula:

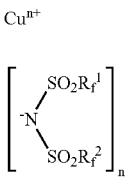

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms and n is an integer from 1 to 2; and (ii) solvent;

b) providing a conductive substrate;

c) bringing the conductive substrate and the solution into contact with each other; and d) applying an electrochemical potential to the conductive substrate sufficient to induce plating of copper from the solution.

Another embodiment of the present invention comprises a method of electrochemically depositing copper interconnects comprising the steps of:

a) providing an electrolytic solution consisting essentially of:

(i) at least one copper bis(perfluoroalkanesulfonyl) imide represented by the formula

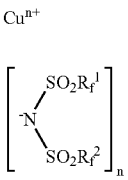

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2;

(ii) solvent;

(iii) acid; and (iv) optionally one or more additive;

b) providing a conductive substrate;

c) bringing the conductive substrate and the solution into contact with each other; and d) applying an electrochemical potential to the conductive substrate sufficient to induce plating of copper from the solution.

Another embodiment of the present invention comprises a method of electrochemically depositing copper interconnects comprising the steps of:

a) providing an electrolytic solution comprising:

(i) at least one copper bis(perfluoroalkanesulfonyl) imide represented by the formula

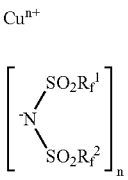

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2; where the concentration of the copper cation ranges from about 0.10 M to about 1.5 M in solvent;

(ii) solvent;

(iii) acid; and (iv) optionally one or more additive.

b) providing a conductive substrate;

c) bringing the conductive substrate and the solution into contact with each other; and d) applying an electrochemical potential to the conductive substrate sufficient to induce plating of copper from the solution.

In yet another embodiment, the present invention comprises an electroless plating solution comprising:

(a) at least one copper bis(perfluoroalkanesulfonyl) imide represented by the formula:

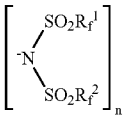

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2; where the concentration of the copper cation ranges from about 0.10 M to about 1.5 M in solvent;

b) solvent; and c) a reducing agent capable of reducing the Cu(1+) or Cu(2+) ion to metallic copper in the presence of a suitable catalyst.

The present invention also comprises copper methide salts having the following formula:

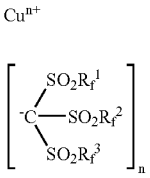

wherein each $R_f$ is independently a perfluorinated alkyl group that may be cyclic or acyclic, may optionally contain catenated or terminal heteroatoms selected from the group consisting of N, O, and S (e.g., —$SF_4$—, —$SF_5$), any two $R_f$ groups may be linked to form a perfluoroalkylene-containing ring, and n is an integer from 1 to 2.

In another aspect, the present invention comprises an electrolytic plating solution comprising or consisting essentially of:

a) at least one copper tris(perfluoroalkanesulfonyl) methide represented by the formula:

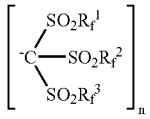

wherein each $R_f$ is independently a perfluorinated alkyl group that may be cyclic or acyclic, may optionally contain catenated or terminal heteroatoms selected from the group consisting of N, O, and S, any two $R_f$ groups may be linked to form a perfluoroalkylene-containing ring, and n is an integer from 1 to 2;

b) solvent;

c) acid; and d) optionally one or more additive.

In yet another embodiment, the present invention comprises an electroless plating solution comprising or consisting essentially of:

a) at least one copper tris(perfluoroalkanesulfonyl) methide represented by the formula:

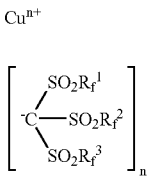

wherein each $R_f$ is independently a perfluorinated alkyl or aryl group that may be cyclic or acyclic, may optionally contain catenated or terminal heteroatoms selected from the group consisting of N, O, and S, any two $R_f$ groups may be linked to form a perfluoroalkylene-containing ring, and n is an integer from 1 to 2;

b) solvent;

c) reducing agent capable of reducing the Cu(1+) or Cu(2+) ion to metallic copper in the presence of a suitable catalyst; and d) optionally one or more additive.

In yet another embodiment, the present invention comprises a method of electrochemically depositing copper interconnects comprising the steps of:

a) providing an electrolytic plating solution comprising:

(i) at least one copper tris(perfluoroalkanesulfonyl) methide represented by the formula:

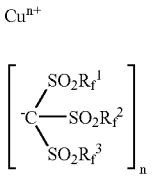

wherein each $R_f$ is independently a perfluorinated alkyl group that may be cyclic or acyclic, may optionally contain catenated or terminal heteroatoms selected from the group consisting of N, O, and S, any two $R_f$ groups may be linked to form a perfluoroalkylene-containing ring, and n is an integer from 1 to 2; and (ii) solvent;

b) providing a conductive substrate;

c) bringing the conductive substrate and solution into contact with each other; and d) applying an electrochemical potential to the conductive substrate sufficient to induce plating of copper from the solution.

In another embodiment, the present invention comprises a method for electroless deposition of copper interconnects comprising the steps of:

a) providing an electroless plating solution comprising:

(i) at least one copper bis(perfluoroalkanesulfonyl) imide represented by the formula:

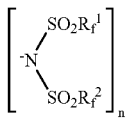

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2;

(ii) solvent; and (iii) a reducing agent capable of reducing the Cu(1+) or Cu(2+) ion to metallic copper in the presence of a suitable catalyst;

b) providing a substrate treated on the surface with an active catalyst;

c) bringing the catalyst treated substrate and the solution into contact with each other; and d) allowing sufficient time for plating of copper from the plating solution to proceed to the desired level.

The present invention also provides a method for electroless deposition of copper interconnects comprising the steps of:

a) providing an electroless plating solution comprising:

(i) at least one copper tris(perfluoroalkanesulfonyl) methide represented by the formula:

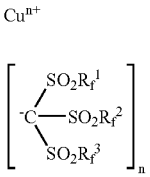

wherein each $R_f$ is independently a perfluorinated alkyl group that may be cyclic or acyclic, may optionally contain catenated or terminal heteroatoms selected from the group consisting of N, O, and S, any two $R_f$ groups may be linked to form a perfluoroalkylene-containing ring, and n is an integer from 1 to 2;

(ii) solvent; and (iii) reducing agent capable of reducing the Cu(1+) or Cu(2+) ion to metallic copper in the presence of a suitable catalyst;

b) providing a substrate treated on the surface with an active catalyst;

c) bringing the catalyst treated substrate and solution into contact with each other; and d) allowing sufficient time for plating of copper from the plating solution to proceed to the desired level.

DETAILED DESCRIPTION OF ILLUSTRATIVE EMBODIMENTS

The present invention relates to plating solutions having copper imide salts or copper methide salts and solvent. A solution is defined herein as a homogeneous mixture. The electrolytic plating solution consists essentially of at least one copper imide salt and solvent. Alternatively, the electrolytic plating solution may comprise at least one copper imide salt and solvent with the proviso that this solution does not contain copper sulfate. Additionally, the electrolytic plating solution may comprise at least one copper methide salt and solvent. The copper imide or methide salt is the source of metallic copper in the electrolytic plating process.

In another aspect, the present invention relates to electroless plating solutions having at least one copper imide salt or at least one copper methide salt, reducing agent, and solvent. The electroless plating solution comprises copper imide or copper methide salt, a chemical reducing agent capable of reducing the copper ions to metallic copper in the presence of an appropriate catalyst, and a solvent. The copper imide or methide salt is the source of metallic copper in the electroless plating process. Electroless plating solutions of the present invention allow plating of copper over a seed layer of catalytic metal (such as Pd) in the absence of an applied electrochemical potential. It is generally preferred that aqueous copper electroless plating solutions are basic (pH>7), which may be accomplished by the addition of sodium hydroxide or some other base or buffer.

The plating solutions of the present invention may comprise a mixture of copper imide and/or copper methide salts with themselves or with other copper salts to achieve optimum plating performance.

Optionally, acid may be added to the electrolytic plating solutions including the conjugate acid of the anion. Other additives, including surfactants, buffers, leveling agents, etc., can also be added to the electrolytic or the electroless plating solution of the present invention. Surfactants and leveling agents are typically present in the 1 to 10,000 ppm range.

The present invention also provides methods of electrochemically or chemically depositing copper interconnects.

The invention also relates to copper methide salts.

Copper Imide Salts

The copper imide salts of the present invention include copper bis(perfluoroalkanesulfonyl) imides. These salts can be represented by the following formula:

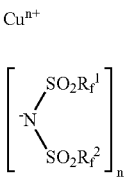

where $R_f^1$ and $R_f^2$ are independently a perfluoroalkyl group containing from 1 to 12 carbon atoms, optionally containing catenated or terminal heteroatoms such as O, N, and S (e.g., —$SF_4$— or —$SF_5$). Preferably, $R_f^1$ and $R_f^2$ contain from 1 to 4 carbon atoms and more preferably contain from 1 to 2 carbon atoms. Any two $R_f$ groups may be linked to form a perfluoroalkylene-containing ring. The copper cation can have an oxidation state of either +1 or +2 (n is an integer from 1 to 2). Preferably, the copper cation is $Cu^{2+}$ when water is the solvent.

Bis(perfluoroalkanesulfonyl) imides may be prepared from perfluoroalkanesulfonyl halides by methods which are well known in the art and described in U.S. Pat. Nos. 5,874,616, 5,723,664, and ZA 9804155. Generally, these anions can be prepared by reacting 2 moles of $R_fSO_2X$ (where X is a halide such as —F or —Cl) with $NH_3$ in the presence of $Et_3N$ (or a similar base) or by reacting $R_fSO_2X$ with $R_fSO_2NH_2$ in the presence of $Et_3N$ (or a similar base). Additionally, solutions of bis(perfluoroalkanesulfonyl) imide salts, such as $Li[N(SO_2CF_3)_2]$, (HQ™-115; available from 3M Company), can be acidified with strong acids to yield bis(perfluoroalkanesulfonyl) imide acids by distillation.

Copper(I) imide salts, wherein the copper ion is in the (1+) oxidation state, may be prepared in organic solvents such as acetonitrile and the like by the reaction of $Cu_2O$ or Cu metal with the anhydrous imide acids ($H—N(SO_2R_f)_2$) according to the general procedure outlined by G. J. Kubas in *Inorganic Syntheses* (1990), 28 (Reagents Transition Met. Complex Organomet. Synth.) 68–70. The Cu(I) imide salts may be isolated as acetonitrile complexes.

Copper (II) imide salts, wherein the copper ion is in the (2+) oxidation state, may be prepared in aqueous or organic solvents by the reaction of $Cu^{II}O$, copper (II) carbonate, Cu(II) hydroxide and the like with imide acids.

Examples of suitable imide anions of the present invention include, but are not limited to:

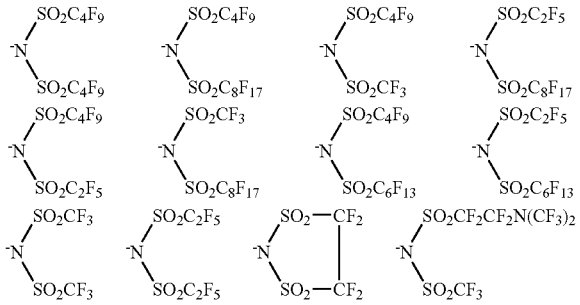

Preferably, the anion is bis(perfluoroethanesulfonyl) imide or bis(perfluoromethanesulfonyl) imide.

Copper Methide Salts

The copper methide salts of the present invention are perfluorinated. These salts can be represented by the following formula:

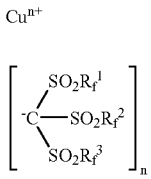

wherein each $R_f$ is independently a perfluorinated alkyl or aryl group that may be cyclic or acyclic and may optionally contain catenated or terminal heteroatoms such as N, O, and S (e.g., —$SF_4$— or —$SF_5$). Any two $R_f$ groups may be linked to form a perfluoroalkylene-containing ring. n is an integer from 1 to 2. $R_f$ has from 1 to 8 carbon atoms, preferably 1 to 4 carbon atoms.

Examples of suitable methide anions include, but are not limited to,

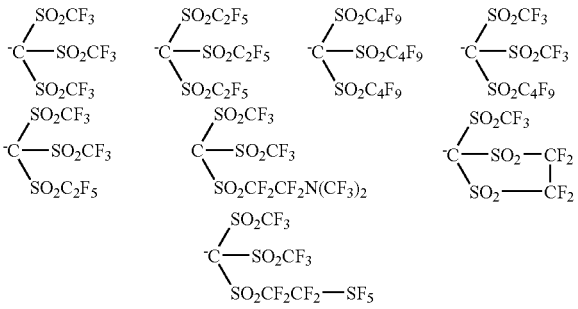

The preparation of perfluorinated methide anions is described in U.S. Pat. Nos. 5,446,134, 5,273,840, 5,554,664, 5,514,493, and in Turowsky & Seppelt, Inorg. Chem., 27, 2135–2137 (1988).

Copper(I) methide salts, wherein the copper ion is in the (1+) oxidation state, may be prepared in organic solvents such as acetonitrile and the like by the reaction of $Cu_2O$ or Cu metal with the anhydrous methide acids ($H—C(SO_2R_f)_3$) according to the general procedure outlined by G. J. Kubas in *Inorganic Syntheses,* (1990), 28 (Reagents Transition Met. Complex Organomet. Synth.) 68–70. The Cu(I) methide salts may be isolated as acetonitrile complexes.

Copper(II) methide salts, wherein the copper ion is in the (2+) oxidation state, may be prepared in aqueous or organic solvents by the reaction of $Cu^{II}O$, copper(II) carbonate, Cu(II) hydroxide and the like with methide acids.

Preferably, the copper cation is $Cu^{2+}$ when water is the solvent.

Solvent

The solvent of the present invention is water or a polar organic solvent. A polar solvent is defined herein as having a dielectric constant greater than 5 at room temperature. Examples of suitable polar organic solvents include, but are not limited to, esters such as methyl formate, ethyl formate, methyl acetate, dimethyl carbonate, diethyl carbonate, propylene carbonate, ethylene carbonate, and butyrolactones (e.g., gamma butyrolactone); nitriles such as acetonitrile and benzonitrile; nitro compounds such as nitromethane or nitrobenzene; amides such as N,N-dimethylformamide, N,N-diethylformamide, and N-methylpyrrolidinone; sulfoxides such as dimethyl sulfoxide; sulfones such as dimethylsulfone, tetramethylene sulfone, and other sulfolanes; oxazolidinones such as N-methyl-2-oxazolidinone and mixtures thereof.

Generally, the copper cation has a concentration of 0.10 M to 1.5 M in the solvent. Preferably, the copper cation has a concentration of 0.20 M to 1.0 M in the solvent.

Reducing Agents and Other Additives for Copper Electroless Plating Solutions

Suitable reducing agents for use in copper electroless plating solutions of the present invention include, but are not limited to, formaldehyde, hypophosphite, organoboron compounds, dimethylamine-borane and borohydride, with formaldehyde generally being preferred. Generally the reducing agent is present in equimolar or excess amounts relative to the amount of copper ion in solution. For electroless plating, preferably the reduction of copper ion by the reducing agent is negligible or slow in the absence of a catalyst, but relatively fast when a catalyst, such as a noble metal particle (e.g., Pd, Pt, Au, etc.), is present. Palladium is generally a preferred catalyst. Other additives useful in optimizing the performance of copper electroless plating solutions include pH adjusters (like NaOH) or buffers, complexing agents (like tartrate and ethylenediaminetetraacetic acid or EDTA) stabilizers (like cyanide and certain sulfur compounds or heterocyclic nitrogen compounds) and additives to control film properties and deposition rates.

Optional Additives Electrolytic Copper Plating Solutions

In some embodiments of the present invention, it may be desirable to add an acid or an acid salt to the electrolytic solution. Suitable acids include, but are not limited to, hydrochloric acid, sulfamic acid, pyrophosphoric acid, fluoroboric acid, phosphoric acid, imide acid, methide acid, acetic acid, oxalic acid, tartaric acid, and citric acid. Sulfuric acid may also be used with copper methide salts. The salts may include sodium, potassium, or other salts of the acids. Generally, the acid is selected such that it is stable relative to the redox potential and has no unfavorable impact on the functioning of the plating process.

Typically, the optional acid is added in a concentration ranging from 50 ppm to 25% by weight.

In some embodiments of the present invention, one or more optional additives may be added to the electrolytic plating solution. These additives include, but are not limited to, additives selected from the group consisting of abrasive particles (e.g., alumina, silica, or cerium) brightening agents (e.g., sulfonic materials, SPS), leveling agents (e.g., a mixed-additive system consisting of chloride ions, PEG, bis-(3-sulfopropyl)-disulfide (SPS), and Janus Green B (JGB), available from Sigma-Aldrich, Milwaukee, Wis.), surfactants, stress-reducers, depolarizers, hardeners, suppressors, accelerators, and various carriers (e.g., 300 mg/L 3350 mw polyethylene glycol (PEG)). Typically these additives are present in a concentration ranging from 1 to 10,000 ppm.

Method for Preparing the Plating Solution

The plating solution of the present invention may be prepared by at least partially dissolving or dispersing the copper bis(perfluoroalkanesulfonyl) imide or copper tris (perfluoroalkanesulfonyl) methide in the solvent or solvent mixture. The plating solutions of the present invention may also be prepared by reacting a copper precursor such as copper metal, copper oxide, or copper hydroxy carbonate with a stoichiometric or excess amount of bis(perfluoroalkanesulfonyl) imide acid or tris(perfluoroalkanesulfonyl) methide acid in an appropriate solvent such as water or a polar organic solvent.

The copper imide or methide salt is generally employed at a concentration such that the conductivity of the electrolytic plating solution allows plating at a reasonable rate and produces a suitable plating morphology.

In the case of electroless plating solutions of the present invention, a reducing agent is also added to the solution, along with other optional additives such as pH adjusters, complexing agents, and stabilizers.

Applications

The electrolytic and electroless plating solutions of the present invention are particularly useful for electrochemically or chemically depositing copper interconnects. The present invention provides a method for electrochemically depositing copper interconnects comprising the steps of:

a) providing an electrolytic plating solution consisting essentially of (i) at least one copper bis(perfluoroalkanesulfonyl) imide represented by the formula:

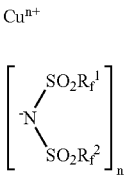

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2; and (ii) solvent;

b) providing a conductive substrate;

c) bringing the conductive substrate and solution into contact with each other; and d) applying an electrochemical potential to the conductive substrate sufficient to induce plating of copper from the solution.

In another embodiment of the present invention, the present invention comprises a method of electrochemically depositing copper interconnects comprising the steps of:

a) providing an electrolytic plating solution consisting essentially of:

(i) at least one copper bis(perfluoroalkanesulfonyl) imide represented by the formula

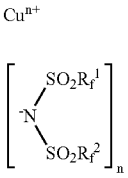

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2;

(ii) solvent;

(iii) acid; and (iv) optionally one or more additive;

b) providing a conductive substrate;

c) bringing the conductive substrate and solution into contact with each other; and d) applying an electrochemical potential to the conductive substrate sufficient to induce plating of copper from the solution.

Another embodiment of the present invention comprises a method of electrochemically depositing copper interconnects comprising the steps of:

a) providing an electrolytic plating solution comprising:

(i) at least one copper bis(perfluoroalkanesulfonyl) imide represented by the formula

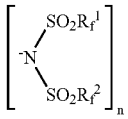

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring; and comprising from 1 to 12 carbon atoms and n is an integer from 1 to 2, where the concentration of the copper cation ranges from about 0.10 M to about 1.5 M in solvent;

(ii) solvent;

(iii) acid; and (iv) optionally one or more additive.

b) providing a conductive substrate;

c) bringing the conductive substrate and solution into contact with each other; and d) applying an electrochemical potential to the conductive substrate sufficient to induce plating of copper from the solution.

In yet another embodiment, the present invention comprises a method of electrochemically depositing copper interconnects comprising the steps of:

a) providing an electrolytic plating solution comprising:

(i) at least one copper tris(perfluoroalkanesulfonyl) methide represented by the formula:

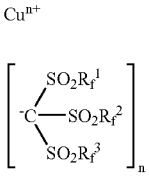

wherein each $R_f$ is independently a perfluorinated alkyl group that may be cyclic or acyclic, may optionally contain catenated or terminal heteroatoms selected from the group consisting of N, O, and S, any two $R_f$ groups may be linked to form a perfluoroalkylene-containing ring, and n is an integer from 1 to 2; and (ii) solvent;

b) providing a conductive substrate;

c) bringing the conductive substrate and solution into contact with each other; and d) applying an electrochemical potential to the conductive substrate sufficient to induce plating of copper from the solution.

The electrolytic plating solution is prepared as described above.

The conductive substrate of the present invention is defined herein as a cathode. This substrate has bulk or surface conductivity sufficient to pass current. For example, in one embodiment of the present invention, copper coated polymer may be used as the cathode. Examples of substrates include, but are not limited to metals, conductive polymers, insulating materials with a thin deposition of metals, and semiconductors.

The conductive substrate is brought into contact with the electrolytic solution typically, but not limited to, by dipping the cathode into the solution.

An electrochemical potential is then applied to the conductive substrate. This electrochemical potential is sufficient to induce plating of copper from the solution. Typically the cell potential ranges from about 100 mv to about 15 volts relative to the counterelectrode in a 2 electrode Hull cell configuration. The rate and the quality of the plating may be controlled by controlling the voltage or the current.

Optionally, a seed layer of copper may be coated on the conductive or insulating substrate (i.e., thereby rendering the insulating substrate conductive on the surface) prior to contacting the conductive substrate with the electrolytic plating solution. This seed layer may be applied using methods known in the art. A thin (1000 Å) copper seed layer may be deposited to promote electrical contact and electrochemical deposition (ECD) of the copper film. The seed layer is usually sputter deposited in a process generally described as a Physical Vapor Deposition (PVD) process.

ECD copper process in Integrated Circuits (I.C.) manufacturing is similar to Printed Wiring Board (PWB), but I.C.s have much smaller critical dimensions and much larger aspect ratios (AR). Higher AR means thinner copper seed at the bottom of the trench before copper ECD, as little as 150 Å Cu seed on the bottom versus 1000 Å Cu seed on the top. A thin seed layer is more prone to corrosion by free acid in electrolyte, thus less free acid may be better. Although, oxidation of the seed layer at the base of a trench slows the copper deposition rate, some oxidation is beneficial because it promotes better wetting of the electrolyte.

In another embodiment of the present invention, the present invention comprises a method for electroless deposition of copper interconnects comprising the steps of:

a) providing an electroless plating solution comprising:

(i) at least one copper bis(perfluoroalkanesulfonyl) imide represented by the formula:

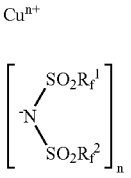

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring; and comprising from 1 to 12 carbon atoms, and n is an integer from 1 to 2;

(ii) solvent; and (iii) reducing agent capable of reducing the Cu(1+) or Cu(2+) ion to metallic copper in the presence of a suitable catalyst;

b) providing a substrate treated on the surface with an active catalyst;

c) bringing the catalyst treated substrate and solution into contact with each other; and d) allowing sufficient time for plating of copper from the plating solution to proceed to the desired level.

The present invention also provides a method for electroless deposition of copper interconnects comprising the steps of:

a) providing an electroless plating solution comprising:

(i) at least one copper tris(perfluoroalkanesulfonyl) methide represented by the formula:

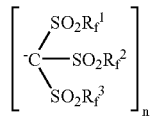

wherein each $R_f$ is independently a perfluorinated alkyl group that may be cyclic or acyclic, may optionally contain catenated or terminal heteroatoms selected from the group consisting of N, O, and S; any two $R_f$ groups may be linked to form a perfluoroalkylene-containing ring, and n is an integer from 1 to 2;

(ii) solvent; and (iii) reducing agent capable of reducing the Cu(1+) or Cu(2+) ion to metallic copper in the presence of a suitable catalyst;

b) providing a substrate treated on the surface with an active catalyst;

c) bringing the catalyst treated substrate and solution into contact with each other; and d) allowing sufficient time for plating of copper from the plating solution to proceed to the desired level.

After electroless or electrochemical plating, the substrate may be rinsed using methods known in the art. Other processing may be performed after plating. For example, the substrate may be coated, polished, chemically treated (e.g., an anti-oxidation treatment may be applied on the surface of the deposition), etc.

EXAMPLES

The present invention will be further described with reference to the following non-limiting examples and test methods. All parts, percentages, and ratios are by weight unless otherwise specified.

Table of Components

| Component | Formula/Structure | Availability |
|---|---|---|
| Activated carbon | DARCO ™ G-60; Activated Carbon | Sigma-Aldrich, Milwaukee, WI |
| $CuCO_3$ $Cu(OH)_2$ | Copper carbonate, basic | Sigma-Aldrich |
| HQ ™ -115 | $Li[N(SO_2CF_3)_2]$ | 3M Company, St. Paul. MN |

Preparation 1

$Cu[N(SO_2CF_3)_2]_2$ Solution

Preparation of $HN(SO_2CF_3)_2$ (i) A 50% aqueous solution of HQ™-115 was placed in glass dishes and dried overnight in an oven at 120° C. This dried material (2276.6 g) was placed in a 5 L, three-necked round-bottom flask equipped with a magnetic stir bar and distillation head. Sulfuric acid (98%; 4482.2 g) was then slowly added to the flask. Upon completion of the addition, the flask was then heated and distillates were collected in a receiving flask at a temperature of 105° C. and pressure of 75 mm Hg (10 kPa). The first fraction was collected (84.4 g) and then a second fraction was collected under the same conditions. The second fraction yielded a clear solid ($HN(SO_2CF_3)_2$ (1981 g; 88.9% yield; mp 40° C.).

(ii) A 4 L Erlenmeyer flask was charged with $CuCO_3.Cu(OH)_2$ (66.3 g; 0.3 moles). $HN(SO_2CF_3)_2$ (55.5% aqueous solution; 1,554.4 g; 3.07 moles; as prepared above) was slowly added, with stirring. The ensuing reaction mixture was diluted with DI water to a final volume of 2.5 L and filtered by gravity. To this solution was added hydrogen peroxide (30% aq; 2.5 mL) and the resulting stirred solution was heated to 70° C. and held at temperature for 3 hours. Then 10 g of activated carbon was added and the suspension was heated for 3 additional hours. The suspension was cooled to room temperature, filtered (0.45μ Nylon Magna Filter, available from Micron Separations Inc., Westboro, Mass.) and HCl (concentrated aq; 0.346 g) was added. The resulting solution was blue/green in color. This preparation used ratios of reactant such that there was free $HN(SO_2CF_3)_2$ remaining in solution.

Preparation 2

The procedure described for Preparation 1 was followed, with the exception that instead of 1,554.4 g of 55.5% aqueous solution of $HN(SO_2CF_3)_2$, 921.5 g (1.82 moles) were used. This preparation used ratios of reactant such that there was free $HN(SO_2CF_3)_2$ remaining in solution.

Preparation 3

The procedure described for Preparation 1 was followed, with the exception that instead of 1,554.4 g of 55.5% aqueous solution of $HN(SO_2CF_3)_2$, 607.6 g (1.20 moles) were used. This preparation used ratios of reactant such that there was no free $HN(SO_2CF_3)_2$ remaining in solution.

Comparative Preparation C1

The procedure described in Preparation 1 (ii) above was followed with the exception that instead of using $HN(SO_2CF_3)_2$, an equimolar amount of sulfuric acid was used.

Comparative Preparation C2

The procedure described in Preparation 2 above was followed with the exception that instead of using $HN(SO_2CF_3)_2$, an equimolar amount of sulfuric acid was used.

Comparative Preparation C3

The procedure described in Preparation 3 above was followed with the exception that instead of using $HN(SO_2CF_3)_2$, an equimolar amount of sulfuric acid was used.

Examples 1–3

Electroplating Using $Cu[N(SO_2CF_3)_2]_2$ Solutions $Cu[N(SO_2CF_3)_2]_2$ solutions from Preparation 1–3 above were charged to different Hull Cells (267 mL; see Jack W. Dini, "Electrodeposition: The materials Science of Coatings and Substrates", pp. 217–20 Noyes Publications, Park Ridge, N.J., 1993.). A copper cathode was obtained from Kocour Company (Chicago, Ill.). The copper cathode was immersed into the electrolyte solution and the cell was operated at constant current (1 Amp). After five minutes, the copper cathode was removed from the Hull Cell. The surface that was plated in each of the three $Cu[N(SO_2CF_3)_2]_2$ electrolytic plating solutions was smooth and bright.

Comparative Examples C1–C3

Electroplating Using $CuSO_4$ Solutions $CuSO_4$ solutions from comparative Preparations C1–C3 above were charged to different Hull Cells. The copper cathode was immersed into the electrolyte solution and the cell was operated at constant current (1 Amp). After five minutes, the copper cathode was removed from the Hull Cell. The surface that was plated in each of the three $CuSO_4$ electrolytic plating solutions was smooth and bright.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims as set forth herein as follows.

What is claimed is:

1. An electrolytic plating solution comprising:

a) at least one copper bis(perfluoroalkanesulfonyl) imide represented by the formula

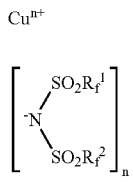

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2; where the concentration of the copper cation ranges from about 0.10 M to about 1.5 M in solvent;

b) solvent;

c) acid; and d) optionally one or more additive.

2. An electrolytic plating solution consisting essentially of:

a) at least one copper bis(perfluoroalkanesulfonyl) imide represented by the formula:

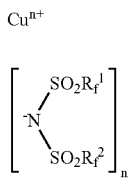

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2;

b) solvent;

c) acid; and d) optionally one or more additive.

3. The electrolytic plating solution according to claim 1 or 2, wherein $R_f^1$ and $R_f^2$ independently comprise from 1 to 4 carbon atoms.

4. The electrolytic plating solution according to claim 1 or 2, wherein $R_f^1$ and $R_f^2$ independently comprise from 1 to 2 carbon atoms.

5. The electrolytic plating solution according to claim 1 or 2, wherein n is 2.

6. The electrolytic plating solution according to claim 1, or 2, wherein said bis(perfluoroalkanesulfonyl) imide is selected from the group consisting of:

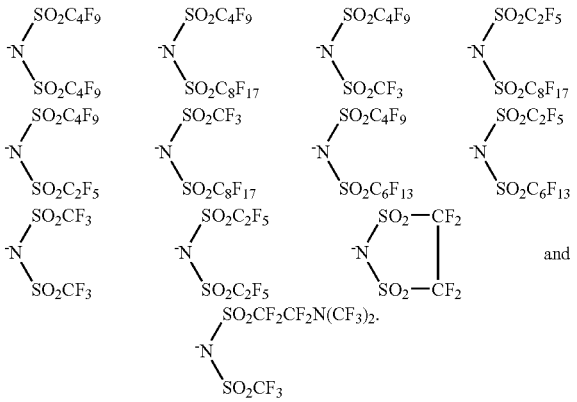

7. The electrolytic plating solution according to claim 1 or 2, wherein said solvent is a polar organic solvent.

8. The electrolytic plating solution according to claim 1 or 2, wherein said solvent is a polar organic solvent selected from the group consisting of esters, nitriles, nitro compounds, amides, sulfoxides, sulfones, sulfolanes, and mixtures thereof.

9. The electrolytic plating solution according to claim 1 or 2, wherein said solvent is water.

10. The electrolytic plating solution according to claim 1 or 2, wherein the $Cu^{n+}$ has a concentration of 0.10 M to 1.5 M in the solvent.

11. The electrolytic plating solution according to claim 1 or 2 wherein in the $Cu^{n+}$ has a concentration of 0.20 M to 1.0 M in the solvent.

12. The electrolytic plating solution according to claim 1 or 2, wherein said acid is selected from the group consisting of hydrochloric acid, sulfamic acid, pyrophosphoric acid, fluoroboric acid, phosphoric acid, imide acid, methide acid, acetic acid, oxalic acid, tartaric acid, citric acid, and mixtures thereof.

13. The electrolytic plating solution according to claim 1 or 2, wherein said acid is selected such that it is stable relative to a redox potential.

14. The electrolytic plating solution according to claim 1 or 2, wherein said one or more additive is selected from the group consisting of brightening agents, leveling agents, surfactants, stress-reducers, depolarizers, hardeners, suppressors, accelerators, buffers, carriers, and mixtures thereof.

15. A method of electrochemically depositing copper interconnects comprising the steps of:

a) providing an electrolytic plating solution consisting essentially of:

(i) at least one copper bis(perfluoroalkanesulfonyl) imide represented by the formula:

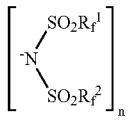

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2; and (ii) solvent;

b) providing a conductive substrate;

c) bringing the conductive substrate and solution into contact with each other; and d) applying an electrochemical potential to the conductive substrate sufficient to induce plating of copper from the solution.

16. A method of electrochemically depositing copper interconnects comprising the steps of:

a) providing an electrolytic plating solution comprising:

(i) at least one copper bis(perfluoroalkanesulfonyl) imide represented by the formula:

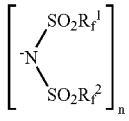

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring; and comprising from 1 to 12 carbon atoms, and n is an integer from 1 to 2; where the concentration of the copper cation ranges from about 0.10 M to about 1.5 M in solvent;

(ii) solvent;

(iii) acid; and (iv) optionally one or more additive, b) providing a conductive substrate;

c) bringing the conductive substrate and solution into contact with each other; and d) applying an electrochemical potential to the conductive substrate sufficient to induce plating of copper from the solution.

17. A method of electrochemically depositing copper interconnects comprising the steps of:

a) providing an electrolytic plating solution consisting essentially of:

(i) at least one copper bis(perfluoroalkanesulfonyl) imide represented by the formula:

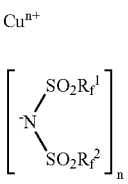

where $R_f^1$ and $R_f^2$ are independently a perfluoroalkyl group that may be cyclic or acyclic, may optionally contain catenated or terminal heteroatoms selected from the group consisting of N, O, and S, any two $R_f$ groups may be linked to form a perfluoroalkylene-containing ring, and comprising from 1 to 12 carbon atoms, and n is an integer from 1 to 2;

(ii) solvent;

(iii) acid; and (iv) optionally one or more additive;

b) providing a conductive substrate;

c) bringing the conductive substrate and solution into contact with each other; and d) applying an electrochemical potential to the conductive substrate sufficient to induce plating of copper from the solution.

18. The method of electrochemically depositing copper interconnects according to claim 15, 16, or 17, wherein said bis(perfluoroalkanesulfonyl) imide is selected from the group consisting of:

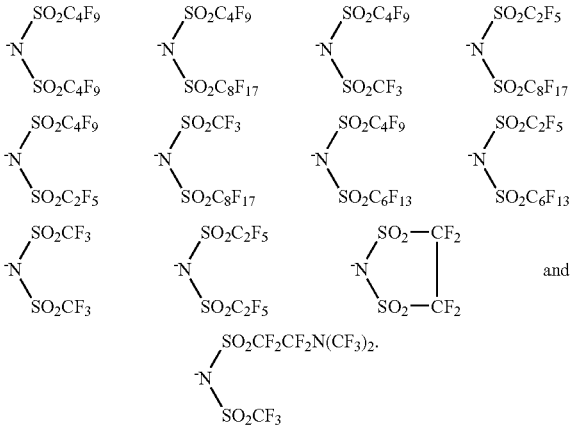

19. The method of electrochemically depositing copper interconnects according to claim 15, 16, or 17, wherein said solvent is a polar organic solvent.

20. The method of electrochemically depositing copper interconnects according to claim 15, 16, or 17, wherein said solvent is water.

21. The method of electrochemically depositing copper interconnects according to claim 15 or 17, wherein the $Cu^{n+}$ has a concentration of 0.10 M to 1.5 M in the solvent.

22. The method of electrochemically depositing copper interconnects according to claim 15, 16, or 17, wherein said conductive substrate has bulk or surface conductivity.

23. The method of electrochemically depositing copper interconnects according to claim 15, 16, or 17, wherein said conductive substrate is selected from the group consisting of metals, conductive polymers, insulating materials with thin deposition of metals, and semiconductors.

24. The method of electrochemically depositing copper interconnects according to claim 15, 16, or 17, further comprising the step of coating the conductive substrate with a seed layer of copper prior to step c).

25. The method of electrochemically depositing copper interconnects according to claim 16 or 17, wherein said acid is selected from the group consisting of hydrochloric acid, sulfuric acid, sulfamic acid, pyrophosphoric acid, fluoroboric acid, phosphoric acid, imide acid, methide acid, acetic acid, oxalic acid, tartanic acid, citric acid, and mixtures thereof.

* * * * *

UNITED STATES PATENT AND TRADEMARK OFFICE

CERTIFICATE OF CORRECTION

PATENT NO. : 7,147,767 B2
APPLICATION NO. : 10/320263
DATED : December 12, 2006
INVENTOR(S) : Steven D. Boyd It is certified that error appears in the above-identified patent and that said Letters Patent is hereby corrected as shown below:

Title Page

Column 1, under item 56 "U.S. PATENT DOCUMENTS", line 2, After "5,652,072" delete "A" and insert -- A * --, therefor.

Column 1, under "U.S. PATENT DOCUMENTS", line 8, After "6,287,973" delete "B1" and insert -- B2 --, therefor.

Column 9

Line 56, Delete "–$SF_4$_" and insert -- –$SF_4$– --, therefor.

Column 22

Line 51, claim 25, delete "tartanic" and Insert -- tartaric --, therefor.

Signed and Sealed this

Nineteenth Day of June, 2007

JON W. DUDAS

*Director of the United States Patent and Trademark Office*